US007745781B2

(12) United States Patent
Steiner

(10) Patent No.: US 7,745,781 B2
(45) Date of Patent: Jun. 29, 2010

(54) REAL-TIME CONTROL OF ION DETECTION WITH EXTENDED DYNAMIC RANGE

(75) Inventor: Urs Steiner, Sunnyvale, CA (US)

(73) Assignee: Varian, Inc., Palo Alto, CA (US)

( * ) Notice: Subject to any disclaimer, the term of this patent is extended or adjusted under 35 U.S.C. 154(b) by 259 days.

(21) Appl. No.: 12/130,182

(22) Filed: May 30, 2008

(65) Prior Publication Data

US 2009/0294643 A1 Dec. 3, 2009

(51) Int. Cl.
*H01J 49/26* (2006.01)

(52) U.S. Cl. ..... 250/282; 250/281

(58) Field of Classification Search ..... 250/281, 250/282, 283, 286, 299, 300; 702/60, 62, 702/23, 24, 25, 26, 27, 28, 31
See application file for complete search history.

(56) References Cited

U.S. PATENT DOCUMENTS 3,946,229 A 3/1976 Moseman et al. ..... 250/292
4,922,106 A * 5/1990 Berrian et al. ..... 250/492.2
6,576,897 B1 6/2003 Steiner et al. ..... 250/292
7,047,144 B2 5/2006 Steiner ..... 702/64
7,238,936 B2 * 7/2007 Okamura et al. ..... 250/284
2004/0084613 A1 5/2004 Bateman et al. ..... 250/281
2009/0194680 A1 * 8/2009 Quarmby et al. ..... 250/282

* cited by examiner

*Primary Examiner*—Jack I Berman
*Assistant Examiner*—Nicole Ippolito Rausch
(74) *Attorney, Agent, or Firm*—Bella Fishman; David P. Gloekler

(57) ABSTRACT

In a method controlling an ion detector, one or more ion input signals are received at the ion detector. A data point indicative of an intensity of at least one of the received ion input signals is acquired. Asynchronously with acquiring the data point, a drive voltage applied to the ion detector is regulated to operate the ion detector at a gain optimal for the intensity of at least one of the received ion input signals. An ion detector for implementing the method is also provided.

20 Claims, 2 Drawing Sheets

REAL-TIME CONTROL OF ION DETECTION WITH EXTENDED DYNAMIC RANGE

FIELD OF THE INVENTION

The present invention relates generally to the detection of ions by means of ion-to-current conversion, which finds use, for example, in fields of analytical chemistry such as mass spectrometry. More particularly, the present invention relates to improving the performance of an analytical instrument such as a mass spectrometer, including its dynamic range, through control of an ion detector that receives the output of the instrument.

BACKGROUND OF THE INVENTION

Mass spectrometry (MS) describes a variety of instrumental methods of qualitative and quantitative analysis that enable ionizable components of a sample to be resolved according to their mass-to-charge ratios. For this purpose, a mass spectrometer converts the sample components into ions, sorts or separates the ions based on their mass-to-charge ratios, and processes the resulting ion output (ion current, flux, beam, etc.) as needed to produce a mass spectrum. Typically, a mass spectrum is a series of peaks indicative of the relative abundances of charged components as a function of mass-to-charge ratio. The information represented by the ion output can be encoded as electrical signals through the use of an appropriate transducer to enable data processing by both analog and digital techniques. An ion detector is a type of transducer that converts ion current to electrical current and thus is commonly employed in an MS system.

Insofar as the present disclosure is concerned, MS systems are generally known and need not be described in detail. Briefly, a typical MS system generally includes a sample inlet system, an ion source or ionization system, a mass analyzer (also termed a mass sorter or mass separator), an ion detector, a signal processor, and readout/display means. Additionally, the modern MS system includes an electronic controller such as a computer or other electronic processor-based device for controlling the functions of one or more components of the MS system, storing information produced by the MS system, providing libraries of molecular data useful for analysis, and the like. The electronic controller may include a main computer that includes a terminal, console or the like for enabling interface with an operator of the MS system, as well as one or more modules or units that have dedicated functions such as instrument control and data acquisition and processing. The MS system also includes a vacuum system to enclose the mass analyzer in a controlled, evacuated environment.

In operation, the sample inlet system introduces a small amount of sample material to the ion source. In hyphenated techniques, the sample inlet system may be the output of an analytical separation instrument such as employed for chromatography, electrophoresis, solid-phase extraction, or other techniques. The ion source converts components of the sample material into a stream of positive and negative ions. One ion polarity is then accelerated into the mass analyzer. The mass analyzer separates the ions according to their respective mass-to-charge ratios. The mass analyzer produces a flux of mass-resolved ions and the ions are collected at the ion detector. The mass analyzer may be of the time-sequenced type such as an ion trap, a Fourier Transform (FT) device, or an ion cyclotron resonance (ICR) device, or may be of the continuous-beam type such as a multipole device, a time-of-flight (TOF) device, or an electric or magnetic sector device.

In certain hyphenated techniques, such as tandem MS or MS/MS, more than one mass analyzer (and more than one type of mass analyzer) may be used. As one example, an ion source may be coupled to a multipole (for example, quadrupole) structure that acts as a first stage of mass separation to isolate molecular ions of a mixture. The first analyzer may in turn be coupled to another multipole structure (normally operated in an RF-only mode) that performs a collision-focusing function and is often termed a collision chamber or collision cell. A suitable collision gas such as argon is injected into the collision cell to cause fragmentation of the ions and thereby produce daughter ions. This second multipole structure may in turn be coupled to yet another multipole structure that acts as a second stage of mass separation to scan the daughter ions. Finally, the output of the second stage is coupled to an ion detector. Instead of multipole structures, magnetic and/or electrostatic sectors may be employed. Other examples of MS/MS systems include the Varian Inc. 1200 series of triple-quadrupole GC/MS systems commercially available from Varian, Inc., Palo Alto, Calif., and the implementations disclosed in U.S. Pat. No. 6,576,897, assigned to the assignee of the present disclosure.

As previously noted, the ion detector functions as a transducer that converts ionic information (which may be mass-discriminated by a mass analyzer) into electrical signals suitable for processing/conditioning by the signal processor, storage in memory, and presentation by the readout/display means. A typical ion detector is an electron-multiplier (EM). The electron multiplier includes, as a first stage, an ion-to-electron conversion device. Ions from the mass analyzer are focused toward the ion-to-electron conversion device. The ion-to-electron conversion device typically includes a surface that emits electrons in response to impingement by ions. The conversion rate mainly depends on the ion's mass, thermal state, charge state, and velocity, and the type of impact surface. The ion conversion stage is followed by an electron multiplier stage. A voltage potential is impressed across the length of a containment structure of the electron multiplier. The electrical current resulting from the ion-to-electron conversion is amplified in the multiplier stage through multiplication of liberated electrons. The gain of this multiplication can be influenced by the applied voltage potential. An anode positioned at the end of the multiplier collects the multiplied flux of electrons and the resulting electrical output current is transmitted to subsequent processes such as a current-to-voltage converter. Another type of ion detector is the photomultiplier (PM). As appreciated by persons skilled in the art, a photo-multiplier may be substituted for an ion detector and operated in an analogous manner.

In MS systems, the ion current input into electron multiplier may range, for example, from about $10^{-1}$ ions (ion counts) per second to greater than $10^{12}$ ions per second. Electron multipliers provide an electrical current gain that may range, for a given construction, from $10^3$ to $10^9$ depending on applied control voltage. In the present context, the gain of the electron multiplier may be expressed as the ratio of its output electrical current to its input ion current. Hence, the output of an ion detector equipped with an electron multiplier is an amplified electrical current proportional to the intensity of the ion current fed to the ion detector, the ion-to-electron conversion rate, and the gain of the electron multiplier. This output current can be processed as needed to yield a mass spectrum that can be displayed or printed by the readout/display means. A trained analyst can then interpret the mass spectrum to obtain information regarding the sample material processed by the MS system.

Like many analytical techniques, figures of merit are associated with the performance of a mass spectrometer. From the above description of the function of the ion detector, it can be seen that the performance of the ion detector and associated collection electronics can significantly affect the performance of the mass spectrometer as a whole. Two important figures of merit are sensitivity and dynamic range, which in the present context can provide a measure of the performance of the ion detector employed in an MS system or other system employing an ion detector. To optimize sensitivity, the detector system needs to be able to detect a single ion entering the ion detector (i.e., single ion counting). To achieve this, the gain of the ion detector is increased until the output current signal exceeds all other sources of noise, with an S/N of about 5:1 when a single ion enters the ion detector. Dynamic range may be characterized as being the range in which the output response to the ion input signal is linear. Dynamic range may be limited by the signal processing circuitry that follows the ion detector or by the maximum allowable output current of the electron multiplier. For example, analog-to-digital converters (ADCs) are often provided to transform the analog signals generated by the ion detector to digital signals in order to take advantage of computerized data acquisition hardware and software. In this case, the dynamic range of an ion detector system can be limited to the maximum input signal range of the ADC. To compensate for this limitation, a user of an MS system has traditionally reduced the gain of the electron multiplier by lowering the high-voltage supplied to the electron multiplier. However, this will result in losing sensitivity because single ions can no longer be detected. Increasing sensitivity such as by increasing gain may exceed the maximum allowable output current of the electron multiplier, and/or prematurely stress or age the specialized material that comprises the surfaces of the electron multiplier. These surfaces are designed to be operated at a gain that results in an optimum output current providing a good S/N ratio and reasonable service life. The means taken for extending dynamic range may reduce sensitivity, lower the precision of detected mass peaks, and, if a high sensitivity is selected, narrow the bandwidth of amplifiers employed in signal processing and/or limit the maximum scan speed of the mass analyzer. Moreover, there has not existed a sufficient method for increasing both dynamic range and sensitivity, or at least increasing dynamic range without adversely affecting sensitivity.

U.S. Pat. No. 7,047,144, commonly assigned to the assignee of the present disclosure, describes apparatus and methods for increasing the dynamic range of an ion detector by changing the gain of the ion detector for each following scan if necessary. After each scan, the digital output signal of the ion detector is then back scaled according to the gain on the ion detector to provide the mass spectrum. The invention disclosed in this patent has been successfully tested and implemented, but may be considered as having some drawbacks. For instance, because the gain is set only once per scan, the dynamic range and sensitivity of all data within that scan is effectively limited to the ion detector gain set for this scan. It is therefore desirable to change the ion detector gain on every sample, rather than on every scan. To improve scan speeds, it is also desired to be able to collect data points very rapidly, for example, every 10 μs for a quadrupole-based MS or every 1 μs for an ion trap-based MS. To change the gain of the electron multiplier by $10^3$, for example, one would need to change the control voltage to the multiplier by about 600 V. Therefore, the implementation of an extended dynamic range technique on a sample-by-sample basis would require a DC amplifier with close to a 600 V/μs slew rate, which in practice is very difficult to do and would require a large amount of power. Additionally, if it is desired to have an ion deprecation accuracy of better than 0.01%, this DC amplifier would also need to be able to settle its output voltage to within 5 V within one sample. In addition, while waiting until the ion detector gain changes, one cannot collect data because the gain of the multiplier would be unknown during this time.

Accordingly, there continues to be a need for improved techniques for optimizing sensitivity and dynamic range in mass spectrometers utilizing ion detectors. In particular, there is a need for optimizing multiplier gain at a rate faster than a scan-by-scan basis, and for optimizing multiplier gain independently of the ion sampling rate.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a method is provided for controlling an ion detector. One or more ion input signals are received at the ion detector. A data point indicative of an intensity of at least one of the received ion input signals is acquired. Asynchronously with acquiring the data point, a drive voltage applied to the ion detector is regulated to operate the ion detector at a gain optimal for the intensity of at least one of the received ion input signals.

According to another implementation, a method is provided for controlling an ion detector. One or more ion input signals are received at the ion detector. The one or more ion signals are converted into one or more electrical detector output signals. One or more of the detector output signals are read. One or more values of a drive voltage applied to the ion detector are read. Based on at least one of the detector output signals and at least one of the drive voltage values read during a first time period, a data point indicative of an intensity of at least one of the received ion input signals is acquired. The acquiring step may include scaling the detector output signal based on the drive voltage value read during the first time period. Based on at least one of the detector output signals and at least one of the drive voltage values read during a second time period asynchronous relative to the first time period, the drive voltage is regulated to operate the ion detector at a gain optimal for the intensity of at least one of the received ion input signals. The regulating step may include determining whether a value for the gain correlated to the drive voltage value read during the second time period is optimal for the ion input signal intensity and, if it is determined that the gain is not optimal, adjusting the drive voltage to provide the optimal gain.

According to another implementation, an ion detector controller is provided. The ion detector controller may include first circuitry configured to apply a drive voltage to an ion detector, second circuitry configured to receive electrical detector output signals from the ion detector proportional to ion input signals received by the ion detector, and third circuitry in signal communication with the first circuitry and the second circuitry configured to acquire a data point indicative of an intensity of at least one of the received ion input signals and, asynchronously with acquiring the data point, regulate the drive voltage applied to the ion detector to operate the ion detector at a gain optimal for the intensity of at least one of the received ion input signals.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

The subject matter disclosed herein generally relates to dynamic adjustment of the gain voltage (also termed control voltage or drive voltage) applied to an ion detector to improve performance. Examples of implementations of methods and related devices, apparatus, and/or systems are described in more detail below with reference to FIGS. 1-5. These examples are described in the context of mass spectrometry. However, any process that utilizes a signal multiplier or like component in conjunction with the detection of ions may fall within the scope of this disclosure. Additional examples include, but are not limited to, vacuum deposition and other fabrication processes such as may be employed to manufacture materials, electronic devices, optical devices, and articles of manufacture.

Figure 1:
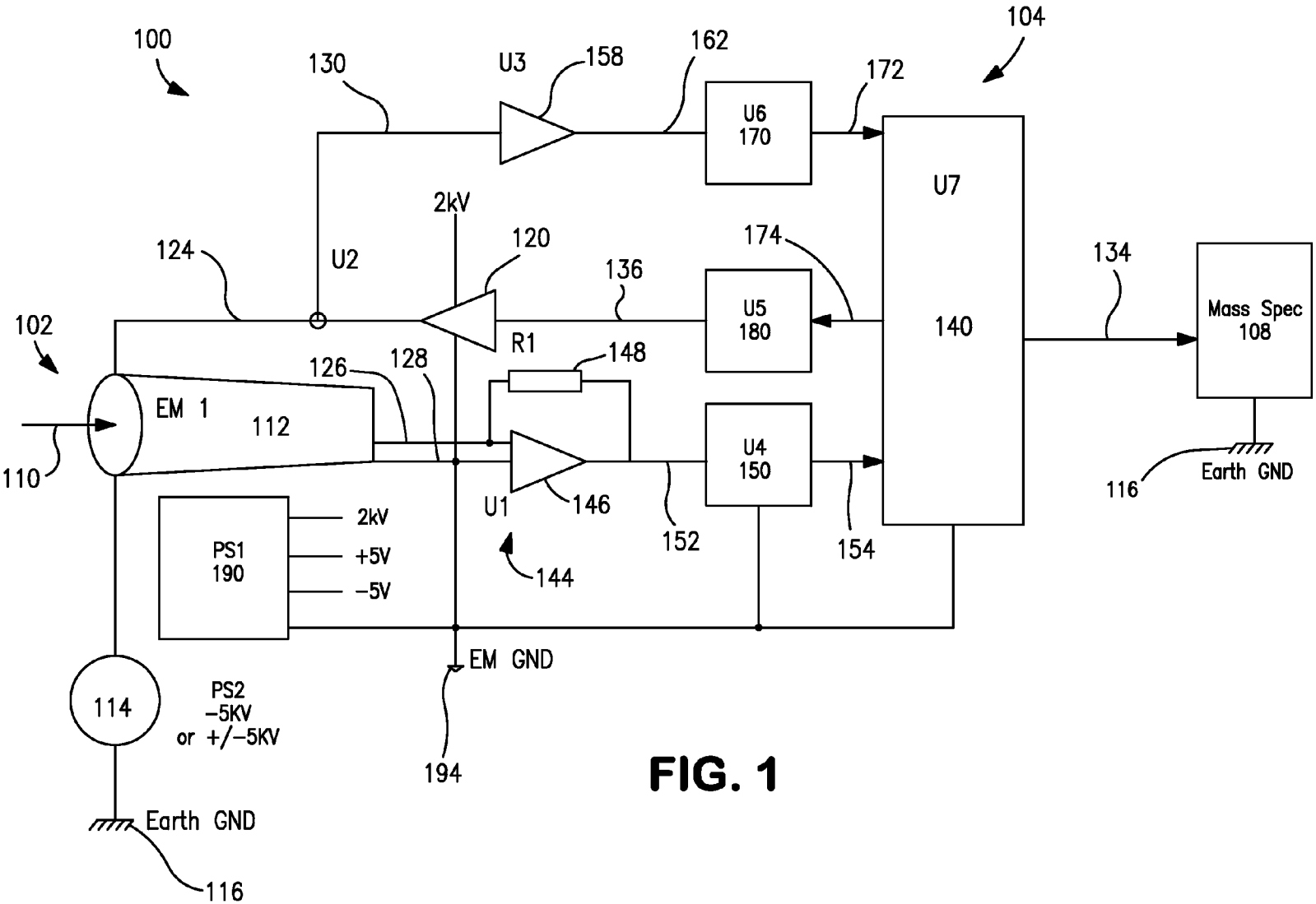
FIG. 1 is a schematic diagram of an example of a portion mass spectrometry system implementing signal processing and detector control.

FIG. 1 illustrates certain components of a mass spectrometry (MS) system (or apparatus, device, etc.), generally designated 100. The MS system 100 includes an ion detector 102, a signal processing and detector control device or circuitry (electronic controller) 104, and a data acquisition device or circuitry (MS electronics) 108. The ion detector 102 receives an input of ions, as generally depicted by an arrow 110, from any suitable source of ions or ion output device (not shown). As one example, a sample introduction device may be employed to introduce a sample to be analyzed into an ion source and the ion source then operated to ionize the sample. The resulting ion stream may be input into the ion detector 102. The ionized sample may first be directed into a mass analyzer and the resulting ion stream (which may be mass-sorted) then input into the ion detector 102.

The implementations of the MS system 100 taught herein are generally compatible with mass spectrometers of any configuration. As further appreciated by persons skilled in the art, the mass analyzer may be a multiple-component mass analyzer capable of performing tandem MS applications (MS/MS analysis) and multiple-MS applications in experiments for which it is beneficial to cause ion fragmentation, such as by collisional-induced dissociation (CID) using an inert gas.

The ion detector 102 includes an electron multiplier 112 that converts the ion signal received from a mass analyzer or other ion output device into an electrical signal (current) indicative of and proportional to the intensity of the received ion signal. Here, the intensity of the ion signal may be given in ion counts per second, and the resulting output electrical signal may be given in Coulombs per second (amperes, or A). A high-voltage power supply source 114 (for example, +5 kV or −5 kV or polarity switchable), placed in communication between the front end of the EM 112 and an earth ground 116, provides the electrical potential required for accelerating ions from the mass analyzer or other ion output device into the EM 112 with an impinging force sufficient for converting the ions to electrons. In implementations employing a PM instead of an EM, the ions are directed to an ion-to-photon converter, such as a phosphor screen. The photons are then converted to electrons on the first stage of the PM, or alternatively the ions may be output from the mass analyzer with enough kinetic energy that a voltage boost is not needed. The polarity of the fixed biasing voltage provided by the power supply 114 depends on whether negative or positive ions are being processed. An EM voltage driver 120, schematically depicted as a DC amplifier, communicates with the front end of the EM 112 over a line 124 and produces an output current signal over a line 126. The EM 112 also communicates with an EM ground 128. An EM ground 194, connected to the EM ground 128, closes the return loop of the control loop. The EM gain voltage of the EM driver 120 determines the overall gain of the EM 112. In one example, the output voltage of the EM driver 120 may be varied from about 600 V to about 2000 V.

The electronic controller 104 is configured to implement two processes or functions, data collection and EM control (optimization), independently and asynchronously of each other. First, to collect data, the electronic controller 104 reads the EM output current and the EM gain voltage at the same time, then using these two values computes the resulting input ion current or flux 110. For example, the electronic controller 104 may read the output signal of the EM 112 over the line 126 and through a current-to-voltage converter 144 and an analog-to-digital converter 150. The EM gain voltage may be read back to the electronic controller 104 through a line 130 and another ADC 170. A calibration curve plotting EM gain voltage vs. EM gain may be stored in or otherwise accessible by the electronic controller 104. Equivalently, a look-up table containing correlated values for EM gain voltage and EM gain may be utilized, and thus for present purposes the terms "curve" and "table" are intended to have interchangeable meanings. The curve or tabular data utilized for calibration may be constructed from running a calibrant compound through the MS system 100, and different calibrant compounds or masses may be run for different EM gain ranges if needed for greater accuracy. Utilizing the calibration curve, the electronic controller 104 finds the EM gain corresponding to the EM gain voltage read from the output of EM 112 and scales the output signal received from the EM 112 accordingly, such as by multiplying the output signal from the EM 112 by the corresponding EM gain. The electronic controller 104 then stores the resulting data point in a memory internal or external to the electronic controller 104. For example, the memory employed for data collection may reside in the MS electronics 108. Thus, data points may be accumulated in a memory in the electronic controller 104 and then transmitted to the MS electronics 108 over a line 134, or alternatively are transmitted to the MS electronics 108 over the line 134 as they are calculated and then accumulated in a memory in the MS electronics 108. The MS electronics 108 processes the data received over the line 134 as needed to produce a mass spectrum of the ion signals received by the EM 112. The foregoing data collection loop may be run, for example, every two microseconds or thereabouts. As an example, the data collection loop, as well as the process for building the EM voltage versus gain table, may be implemented in whole or in part via software algorithms.

Second, independently and asynchronously of the data collection/scaling process, the electronic controller 104 implements a control loop (and algorithm) to optimize the gain of the EM 112 in real time. In this control loop, the electronic controller 104 reads the detector signal output by the EM 112, determines the optimal detector gain for the level of this output (or, stated differently, based on the intensity level of the ion signal input to the EM 112), and adjusts the EM drive voltage over a line 136 input to the EM driver 120 and thereby adjusts the gain of the EM 112. In adjusting the EM drive voltage, the electronic controller 104 in one example implements a transfer function that is non-linear with parameters designed such that AC behavior is adjusted to match the bandwidth of the EM driver 120, as described by example below. As an example, the control loop may be implemented in whole or in part via a software algorithm.

In the implementation described in above-referenced U.S. Pat. No. 6,576,897, gain regulation was limited to being done synchronously with data acquisition and on a scan-by-scan basis. By contrast, in the present implementation gain regulation and data acquisition are done asynchronously, and at a rate other than the ion collection data rate, to take into account the AC behavior of the EM driver. A full mass scan is not required before adjusting the gain. The gain may be adjusted in accordance with a sample rate of the control loop that is independent of the rate of data collection. Data collection (i.e., reading the EM output signal and EM drive voltage, and scaling the output signal) may occur at faster rates and still provide accuracy, while the gain adjustment may occur at a much slower rate but significantly faster than in previously known implementations such as that described in U.S. Pat. No. 6,576,897, limited only by the operation of the EM 112 and the saturation rate of the electrometer receiving the output of the EM 112. For example, data collection may occur every 1 μs while gain adjustment occurs every 20 μs. By this configuration, gain regulation occurs essentially continuously on a true real-time basis. Dynamic range can be extended using an EM driver of only moderate speed, for example one operating at a slew rate of 10 V/μs. It will be noted that the travel time of electrons within the EM 112 is small (for example, less than 1 ns) as compared with a maximum slew rate of 10 V/μs, and therefore any resulting gain error would be very small. By utilizing the present implementation, the dynamic range attained is expected to exceed $10^{12}$. Additionally, the present implementation is operable with both continuous-beam and time-sequenced MS systems, whereas the implementation described in U.S. Pat. No. 6,576,897 does not regulate gain fast enough or with enough precision to be operable with ion traps.

FIG. 1 illustrates one non-limiting example of how the electronic controller 104 may be structured, with the appreciation that the invention encompasses variations and modifications by which features and functions described in the present disclosure may be implemented. In this example, the electronic controller 104 utilizes a digital signal processor or DSP 140 to implement signal processing and control functions, although it will be understood that analog circuitry may alternatively be utilized as the controller. The electrical current output on the line 126 from the EM 112 is fed to an electrometer 144 schematically represented by a current-to-voltage amplifier 146 with a feedback resistance 148. The electrometer 144 converts the analog current signal into an analog voltage signal and transmits this voltage signal to an analog-to-digital converter or ADC 150 via a line 152. The resulting digitized electrometer signal (indicative of the output of the EM 112) is transmitted to the DSP 140 via a line 154. The output from the EM driver 120 is transmitted over the line 130 to a voltage divider 158, and the output from the voltage divider 158 is transmitted over a line 162 to another ADC 170. The resulting digitized EM driver output is then transmitted to the DSP 140 via a line 172. The DSP 140 transmits digital control signals via a line 174 to a digital-to-analog converter or DAC 180, which transmits the resulting analog signals to the EM driver 120 over the line 136. In operation, the EM driver 120 functions as a gain stage for the DAC 180 in this example. Accordingly, the DSP 140 obtains readings of EM signal output via the ADC 150 and readings of EM driver output via the ADC 170, and regulates the EM driver 120 via the DAC 180. In one example, the ADCs 150 and 170 are 16-bit devices operating at conversion rates of around 1 MHz, and the DAC 180 is a 16-bit device operating at a conversion rate of greater than 100 kHz.

During data collection, the DSP 140 scales the ionic data as described above, filters the scaled data according to the expected peak shape and scan speed, and then transmits the data to the MS electronics 108 via the line 134. The use of the DSP 140 in filtering the raw data is advantageous for improving noise removal and therefore the S/N ratio of the data, especially at low signal levels. Moreover, because the output current from the EM 112 may be kept within manufacturing specifications even on very large input signals, the lifespan of the EM 112 is extended.

As also illustrated in FIG. 1, a floating power supply 190 may be utilized to power the illustrated circuitry in this example. The floating power supply 190 may power the EM gain driver 120 at a fixed rail voltage (for example, 2 kV). The circuitry, including the EM output, is referenced against an EM ground 128, producing the floating EM ground 194. Thus, the EM ground 194 changes relative to the earth ground 116 in dependence on the EM gain, for example from −3 KV to −5 kV for positive ions and +5 kV to +7 kV for negative ions. Because in this example the DSP 140 is also referenced against the EM ground 194, the digital data results produced by the DSP 140 should be isolated from the downstream MS electronics 108. Accordingly, in this example, the data output line 134 may represent an optical transmission such as may be implemented through a light pipe or optical fiber system and suitable associated components (for example, an LED, optocouplers, phototransistor, etc. as described in U.S. Pat. No. 6,576,897).

Figure 2:
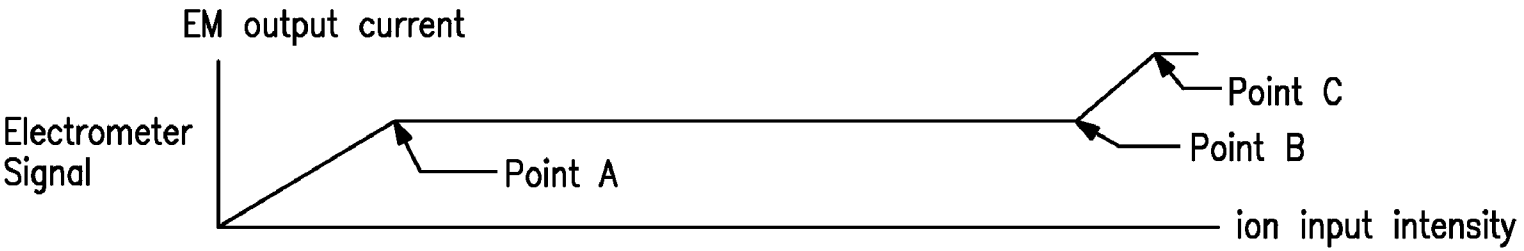
FIG. 2 is a graph of an example of electrometer output intensity as a function of ion input signal intensity.
Figure 3:
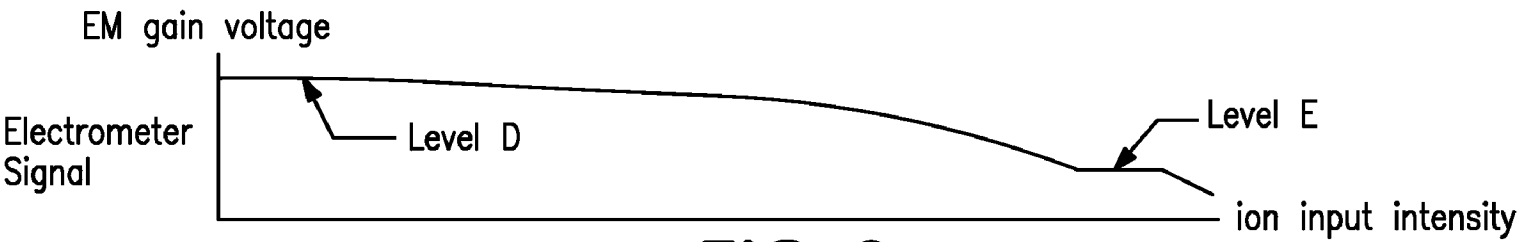
FIG. 3 is a graph of an example of signal multiplier drive voltage as a function of ion input signal intensity.
Figure 4:
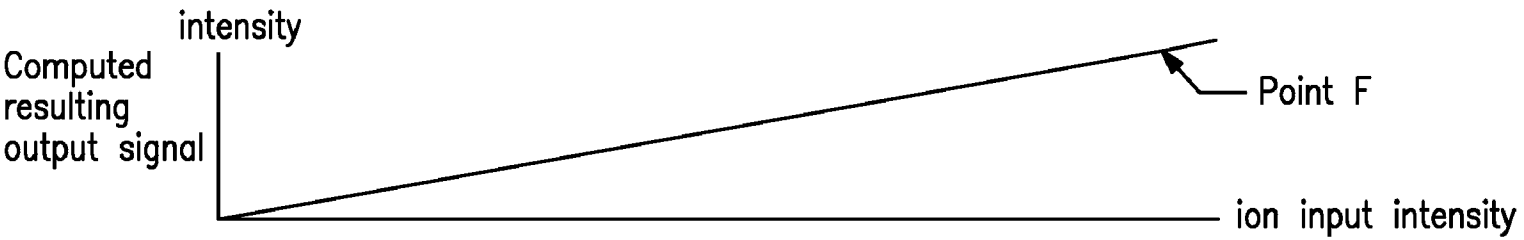
FIG. 4 is a graph of an example of signal processor data output as a function of ion input signal intensity.

An example of the operation of the control loop implemented by the electronic controller 104 will now be described with reference to FIGS. 2-5. FIG. 2 is a graph of an example of electrometer output intensity as a function of ion input intensity, resulting from the ion-to-current conversion and multiplication of the ion signal input to the EM 112 and current-to-voltage conversion performed by the electrometer 144. FIG. 3 is a graph of an example of EM gain voltage as a function of ion input intensity, resulting from application of the transfer function or algorithm by the DSP 140 in response to the intensity level of the ion input signal (as may be derived from the detected level of the electrometer output). FIG. 4 is a graph of an example of signal processor data output as a function of ion input intensity computed by the DSP 140.

At time=0, there is no ion input signal. The gain of the EM 112 is set to a maximum value representing the detector gain needed to detect a single ion event, as shown by Level D of the EM gain voltage in FIG. 3. This maximum gain value may be determined prior to the present sample run by optimizing sensitivity as described above (e.g., single ion detection with a S/N>5). After time=0, the EM 112 begins to receive the ion input signal and results in a detected electrometer output signal (FIG. 2). Up to point A of the electrometer signal, the detector gain is maintained at the constant, maximum value (FIG. 3) to ensure that the EM 112 has enough gain to detect all ions entering the EM 112. The period from time 0 to point A may be referred to as an ion counting mode. The level of the electrometer signal at point A depends on how much overshoot is expected to be needed, and is a function of the expected maximum flux change and the speed of the EM gain driver. In one example, the signal level at point A is 80% of the full scale of the electrometer signal.

The control loop begins after the DSP 140 detects that the level of the electrometer signal has reached point A. After point A, the control loop maintains the electrometer signal at a constant level (FIG. 2) by regulating the EM drive voltage down (FIG. 3), as described above. As an example, the DSP 140 may include a proportional-integral-derivative or PID-type controller for this purpose. As noted above, the parameters of the transfer function are designed to match the AC characteristics of the DC amplifier (EM driver 120). If the ion input signal changes fast, it is possible for the regulator to fall behind. The extra 20% headroom on the electrometer signal (see FIG. 2, point A to point B) is maintained to deal with this possibility. Because the electron multiplication vs. EM drive voltage is non-linear, the resulting detector gain curve (and thus the EM drive voltage vs. ion input intensity curve of FIG. 3 during implementation of the control loop) is likewise non-linear. Alternatively, if the intensity of the ion input signal were decreasing, the EM drive voltage would be regulated up to maintain a constant electrometer signal.

Point B of the electrometer signal (FIG. 2) corresponds to Level E of the EM drive voltage (FIG. 3). At point B, the gain on the EM 112 is becoming very nonlinear and is falling off so steep that data precision would be lost beyond this point. Like the maximum gain value corresponding to Level D of the EM drive voltage, the minimum gain value corresponding to Level E of the EM drive voltage is previously determined by empirical procedures while constructing the gain vs. EM drive voltage calibration curve. Accordingly, beyond point B, the EM drive voltage is kept constant at the Level E value. Consequently, the electrometer output signal is permitted to rise up to point C (FIG. 2). Point C of the electrometer output signal corresponds in time to Point F of the computed data output signal (FIG. 4). It is seen that up to Point F, the computed data output signal response is linear with the ion input signal. At Point C/Point F, the EM 112 has reached saturation. The EM 112 is operating at the lowest drive voltage that still gives linearity, which corresponds to the maximum value for the ion input signal that can be detected with the desired level of accuracy (e.g., 0.01%). Operation beyond Point C/Point F may be referred to as an overdrive mode, during which time the EM drive voltage is again lowered while keeping the electrometer output signal at 100% full scale. During the overdrive mode, the computed data output signal is distorted and is utilized for diagnostic purposes only.

An example of collecting a detector gain (EM voltage vs. gain) table is as follows. First, the detector gain for one EM voltage is found by detecting single ions. This may be done by turning the ion beam off, setting the detector gain to a maximum value (e.g., 2000 V), adjusting the detector zero indication until the EM signal reads zero, and then turning the ion beam on. The ion current is then reduced until single-ion events can be detected (e.g., about 10 ions/sec), in which case, when the EM signal is mostly zero, ions show up as pulses. The EM voltage is then reduced until pulse height is, for example, about 3 times the noise level. The detector gain is then computed for this reduced EM voltage, which will be referred to as the reference EM voltage. The $EM_{out}$ current is set to be equal to mean EM signal/current-to-voltage converter gain. The $EM_{in}$ current is set to be equal to 1*ion-to-electron conversion constant. The ion-to-electron conversion constant may be determined from log(mass)*material constant, where the material constant depends on the material of the surface of the ion detector utilized to convert ions to electrons. Then, reference detector gain=$EM_{out}$ current/$EM_{in}$ current. The reference detector gain so found may also be utilized as the upper limit within the control loop utilized for detector regulation, as single ions will produce a 3-times larger signal then all other electronic noise sources. More gain will not change the signal-to-noise ratio, but may decrease the service lifetime of the EM and limit dynamic range. It will be noted that in the process of collecting the EM voltage vs. gain data, the gain on the current-to-voltage converter (electrometer) need not be taken into account.

Second, a relative EM gain curve is collected. This may be done by supplying a constant ion input signal, changing EM voltage over the available range, and recording the mean detector signal.

Third, the relative EM gain curve is converted to the detector gain curve by scaling the relative EM gain curve. The scaling factor may be scale=reference detector gain/relative EM signal, where the relative EM signal is that corresponding to the reference EM voltage.

An example of implementing the detector regulation loop is as follows. The aim here is to change the detector gain to keep up with the ion signal change when scanning the MS. In this manner, the regulation speed is dependent on the scan speed (data rate) and should be about ten times faster than the scan speed. For the example of the scan speed being 1000 amu/sec, the speed of detector regulation would be every 100 microseconds. First, utilizing the data collected during the data collection loop, the current ion signal is read. The target gain is set to be equal to current input signal/target output signal (see point A in FIG. 2). The target EM voltage is acquired by looking up the target gain in the detector gain table. If the target EM voltage is greater than the reference EM voltage (see discussion above regarding the use of the detector gain as the upper limit for detector regulation), then the target EM voltage is set to be the reference EM voltage (see level D in FIG. 3). If the target EM voltage is less than the minimum EM voltage (nonlinear area, see point B in FIG. 2 and level E in FIG. 3), and if the detector output signal is less than the maximum detector signal (up to point C in FIG. 2), then the target EM voltage is set to be the minimum EM voltage. The EM change (the amount of adjustment needed to operate at the target EM voltage) is the absolute value of (current EM voltage−target EM voltage). If the EM change is greater than the maximum EM slew rate (the operating limit of the EM hardware), then the target EM voltage=current EM voltage+ or −maximum EM slew rate. The hardware EM voltage is then set to the target EM voltage.

It will be understood that the methods and apparatus described in the present disclosure may be implemented in an MS system 100 as generally described above and illustrated in FIG. 1 by way of example. The present subject matter, however, is not limited to the specific MS system 100 illustrated in FIG. 1 or to the specific arrangement of circuitry and components illustrated in FIG. 1. Moreover, the present subject matter is not limited to MS-based applications, as previously noted.

It will be understood, and is appreciated by persons skilled in the art, that one or more processes, sub-processes, or process steps described in connection with FIGS. 1-6 may be performed by hardware and/or software. If the process is performed by software, the software may reside in software memory (not shown) in a suitable electronic processing component or system such as, for example, the DSP 140 and/or MS electronics 108 schematically depicted in FIG. 1. The software in software memory may include an ordered listing of executable instructions for implementing logical functions (that is, "logic" that may be implemented either in digital form such as digital circuitry or source code or in analog form such as analog circuitry or an analog source such an analog electrical, sound or video signal), and may selectively be embodied in any computer-readable (or signal-bearing) medium for use by or in connection with an instruction execution system, apparatus, or device, such as a computer-based system, processor-containing system, or other system that may selectively fetch the instructions from the instruction execution system, apparatus, or device and execute the instructions, one example being the DSP 140 and/or MS electronics 108 schematically depicted in FIG. 1. In the context of this disclosure, a "computer-readable medium" and/or "signal-bearing medium" is any means that may contain, store, communicate, propagate, or transport the program for use by or in connection with the instruction execution system, apparatus, or device. The computer readable medium may selectively be, for example, but is not limited to, an electronic, magnetic, optical, electromagnetic, infrared, or semiconductor system, apparatus, device, or propagation medium. More specific examples, but nonetheless a non-exhaustive list, of computer-readable media would include the following: an electrical connection (electronic) having one or more wires, a portable computer diskette (magnetic), a RAM (electronic), a read-only memory "ROM" (electronic), an erasable programmable read-only memory (EPROM or Flash memory) (electronic), an optical fiber (optical), and a portable compact disc read-only memory "CDROM" (optical). Note that the computer-readable medium may even be paper or another suitable medium upon which the program is printed, as the program can be electronically captured, via for instance optical scanning of the paper or other medium, then compiled, interpreted or otherwise processed in a suitable manner if necessary, and then stored in a computer memory.

In general, terms "communicate" and "in . . . communication with" (for example, a first component "communicates with" or "is in communication with" a second component) is used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be further understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for controlling an ion detector comprising:

receiving one or more ion input signals at the ion detector;

acquiring a data point indicative of an intensity of at least one of the received ion input signals; and asynchronously with acquiring the data point, regulating a drive voltage applied to the ion detector to operate the ion detector at a gain optimal for the intensity of at least one of the received ion input signals.

2. The method of claim 1, wherein:

acquiring comprises, during a first time period, reading a detector output signal converted by the ion detector from at least one of the received ion input signals, and reading a value of a drive voltage applied to the ion detector; and regulating comprises reading the detector output signal and the drive voltage value during a second time period asynchronous relative to the first time period.

3. The method of claim 2, wherein acquiring comprises scaling the detector output signal based on the drive voltage value read during the first time period, and regulating includes determining whether a value for the gain correlated to the drive voltage value read during the second time period is optimal for the ion input signal intensity and, when it is determined that the gain is not optimal, adjusting the drive voltage to provide the optimal gain.

4. The method of claim 1, wherein regulating comprises decreasing the drive voltage in response to an increase in ion input signal intensity and increasing the drive voltage in response to a decrease in ion input signal intensity.

5. The method of claim 1, wherein regulating comprises reading a detector output signal converted by the ion detector from at least one of the received ion input signals, and implementing a nonlinear transfer function that maintains the detector output signal at a constant value.

6. The method of claim 5, wherein reading the detector output signal comprises reading an electrometer output signal converted from a current signal received from the ion detector.

7. The method of claim 1, wherein regulating comprises reading a detector output signal converted by the ion detector from at least one of the received ion input signals, and further including, prior to regulating, setting the gain to a maximum gain value needed to detect a single ion event, determining whether the detector output signal has reached a maximum detector output signal value equal to a percentage of a full scale value and, if it is determined that the detector output signal has reached the maximum detector output signal value, initiating the regulating of the drive voltage.

8. The method of claim 7, wherein regulating comprises implementing a nonlinear transfer function that maintains the detector output signal at a constant value after regulating has been initiated.

9. The method of claim 8, further comprising during regulating, determining whether the drive voltage has reached a minimum drive voltage value and, if it is determined that the drive voltage has reached the minimum drive voltage value, permitting the value of the detector output signal to increase.

10. The method of claim 1, wherein acquiring the data point occurs at a rate greater than 100 kHz, and regulating the drive voltage occurs at a rate greater than 10 kHz.

11. A method for controlling an ion detector comprising:

receiving one or more ion input signals at the ion detector;

converting the one or more ion signals into one or more electrical detector output signals;

reading one or more of the detector output signals;

reading one or more values of a drive voltage applied to the ion detector;

based on at least one of the detector output signals and at least one of the drive voltage values read during a first time period, acquiring a data point indicative of an intensity of at least one of the received ion input signals, wherein acquiring includes scaling the detector output signal based on the drive voltage value read during the first time period; and based on at least one of the detector output signals and at least one of the drive voltage values read during a second time period asynchronous relative to the first time period, regulating the drive voltage to operate the ion detector at a gain optimal for the intensity of at least one of the received ion input signals, wherein regulating includes determining whether a value for the gain correlated to the drive voltage value read during the second time period is optimal for the ion input signal intensity and, if it is determined that the gain is not optimal, adjusting the drive voltage to provide the optimal gain.

12. The method of claim 11, wherein adjusting comprises decreasing the drive voltage in response to an increase in ion input signal intensity and increasing the drive voltage in response to a decrease in ion input signal intensity.

13. The method of claim 11, wherein adjusting comprises implementing a nonlinear transfer function that maintains the detector output signal at a constant value.

14. The method of claim 11, further comprising prior to regulating, setting the gain to a maximum gain value needed to detect a single ion event, determining whether the detector output signal has reached a maximum detector output signal value equal to a percentage of a full scale value and, when it is determined that the detector output signal has reached the maximum detector output signal value, initiating the regulating of the drive voltage.

15. The method of claim 14, wherein adjusting comprises implementing a nonlinear transfer function that maintains the detector output signal at a constant value after regulating has been initiated; and during regulating, determines whether the drive voltage has reached a minimum drive voltage value and, when it is determined that the drive voltage has reached the minimum drive voltage value, permitting the value of the detector output signal to increase.

16. An ion detector controller comprising:

first circuitry configured to apply a drive voltage to an ion detector;

second circuitry configured to receive electrical detector output signals from the ion detector proportional to ion input signals received by the ion detector; and third circuitry in signal communication with the first circuitry and the second circuitry configured to acquire a data point indicative of an intensity of at least one of the received ion input signals and, asynchronously with acquiring the data point, regulate the drive voltage applied to the ion detector to operate the ion detector at a gain optimal for the intensity of at least one of the received ion input signals.

17. The ion detector controller of claim 16, wherein the third circuitry is configured to read the detector output signal and a value of the drive voltage during a first time period to acquire the data point, and read the detector output signal and a value of the drive voltage during a second time period asynchronous relative to the first time period to regulate the drive voltage.

18. The ion detector controller of claim 17, wherein the third circuitry is configured to acquire the data point by scaling the detector output signal based on the drive voltage value read during the first time period, and regulate the drive voltage by determining whether a value for the gain correlated to the drive voltage value read during the second time period is optimal for the ion input signal intensity and, if it is determined that the gain is not optimal, adjusting the drive voltage to provide the optimal gain.

19. The ion detector controller of claim 16, wherein the first circuitry includes a DC amplifier, the second circuitry includes an electrometer, and the third circuitry includes an analog processor.

20. The ion detector controller of claim 16, further including a first ADC configured to receive a value of the drive voltage from the first circuitry, wherein the first circuitry includes a DC amplifier and a DAC in signal communication with an input of the DC amplifier, the second circuitry includes an electrometer and a second ADC in signal communication with an output of the electrometer, and the third circuitry includes a digital processor in signal communication with the first ADC, the DAC and the second ADC.

* * * * *